US009583086B2

(12) United States Patent
Takata et al.

(10) Patent No.: US 9,583,086 B2
(45) Date of Patent: Feb. 28, 2017

(54) KEYBOARD DEVICE OF ELECTRONIC MUSICAL INSTRUMENT

(71) Applicant: Roland Corporation, Shizuoka (JP)

(72) Inventors: Yukihide Takata, Shizuoka (JP); Yukihiro Morohashi, Shizuoka (JP); Shiro Uno, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 14/931,859

(22) Filed: Nov. 4, 2015

(65) Prior Publication Data

US 2016/0293152 A1 Oct. 6, 2016

(30) Foreign Application Priority Data

Mar. 31, 2015 (JP) ..... 2015-071965

(51) Int. Cl.
*G10C 3/12* (2006.01)
*G10H 1/34* (2006.01)

(52) U.S. Cl.
CPC ..... *G10H 1/34* (2013.01); *G10H 1/346* (2013.01); *G10H 2220/221* (2013.01)

(58) Field of Classification Search
USPC ..... 84/744
See application file for complete search history.

(56) References Cited

U.S. PATENT DOCUMENTS 7,217,877 B2 * 5/2007 Funaki ..... G10C 3/12 84/433
7,485,798 B2 * 2/2009 Nishida ..... G10C 3/12 84/18
8,530,732 B2 * 9/2013 Suzuki ..... G10H 1/346 84/243
2011/0005369 A1 * 1/2011 Kamimura ..... G10C 3/12 84/423 R
2013/0152769 A1 * 6/2013 Suzuki ..... G10H 1/34 84/719
2016/0071498 A1 * 3/2016 Hoshino ..... G10C 3/22 84/433

FOREIGN PATENT DOCUMENTS

| | | |
|---|---|---|
| JP | H06-025884 | 2/1994 |
| JP | 2004-226687 | 8/2004 |
| JP | 2006-003495 | 1/2006 |
| JP | 2007-025589 | 2/2007 |
| JP | 2007-052400 | 3/2007 |
| JP | 2010-078791 | 4/2010 |

* cited by examiner

*Primary Examiner* — Christopher Uhlir
(74) *Attorney, Agent, or Firm* — Jianq Chyun IP Office

(57) ABSTRACT

The invention provides a keyboard device of an electronic musical instrument, wherein a hammer can be installed correctly by a simple operation of pressing a key. The keyboard device of the electronic musical instrument includes: a chassis; a key disposed rotatably on the chassis and extending from the rear to a front; a support shaft disposed on the chassis in front of the rotation center; a hammer rotating in conjunction with the key along with pressing on the front of the key; a retaining hole formed through the hammer and retaining the support shaft; a guide groove guiding the support shaft in the retaining hole; and a shifting means, shifting from a temporarily secured state to a retained state, and pressing the hammer in the temporarily secured state toward the rear to shift the hammer to the retained state along with the pressing on the front of the key.

20 Claims, 5 Drawing Sheets

KEYBOARD DEVICE OF ELECTRONIC MUSICAL INSTRUMENT

CROSS REFERENCE TO RELATED APPLICATIONS

This application claims the priority benefit of Japan Application No. 2015-071965, filed on Mar. 31, 2015. The entirety of the above-mentioned patent application is hereby incorporated by reference herein and made a part of this specification.

BACKGROUND OF THE INVENTION

Field of the Invention

The invention relates to a keyboard device of an electronic musical instrument and more particularly relates to a keyboard device of an electronic musical instrument, in which the hammer can be installed correctly by a simple operation of pressing the key.

Description of Related Art

Conventionally, electronic musical instruments such as an electronic piano are known. In the electronic musical instrument, e.g. the electronic piano, a hammer is provided rotatably under the key. When the key is pressed, the hammer rotates against its own weight and therefore can apply a predetermined load to the key when the key is pressed and create a key operational feeling similar to that of an acoustic piano.

With respect to the hammer, the following Patent Literature 1 has disclosed a hammer 3 that includes a hammer body 20 and a bearing portion 30 formed integrally with the hammer body 20. A retaining hole 30*a* is formed at the center of the bearing portion 30, and a guide groove 30*b* is formed in the rear (the side of the key support shaft 14 of the key 2) of the retaining hole 30*a*. A support shaft 28 is disposed on a keyboard chassis 1 and the support shaft 28 is retained in the retaining hole 30*a*. That is, with the support shaft 28 retained in the retaining hole 30*a* through the guide groove 30*b*, the hammer 3 disclosed in the following Patent Literature 1 is disposed rotatably around the support shaft 28.

SUMMARY OF THE INVENTION

Problem to be Solved

However, it is a problem that complicated work is required in order to retain the support shaft 28 in the retaining hole 30*a* through the guide groove 30*b*, as described in the above Patent Literature 1.

That is, the guide groove 30*b* is formed into a shape that is tapered toward the retaining hole 30*a* so as to keep the support shaft 28 from falling out of the retaining hole 30*a*. Thus, to retain the support shaft 28 in the retaining hole 30*a*, it is necessary to push the retaining hole 30*a* toward the support shaft 28. However, on both sides of the hammer 3, the keyboard chassis 1 is set upright with a slight gap between the keyboard chassis 1 and the hammer 3, which is unfavorable for workability and makes it difficult to push the retaining hole 30*a* to the support shaft 28.

Thus, in the case of retaining the support shaft 28 in the retaining hole 30*a*, the support shaft 28 is temporarily secured in the guide groove 30*b* in advance and a special jig is set to the keyboard chassis 1 and the hammer 3 to be used for pushing the retaining hole 30*a* to the support shaft 28, so as to correctly install the hammer 3. In this way, to correctly install the hammer 3, it is necessary to prepare and set the special jig after temporarily securing the support shaft 28 in the guide groove 30*b*. The inevitable complicated work is a problem.

In addition, if multiple hammers 3 are to be installed at the same time, a large force corresponding thereto will be required. Therefore, the installation process of the hammer 3 is carried out one by one. Thus, the work would become more complicated as the number of hammers 3 increases.

In view of the aforementioned problems, the invention provides a keyboard device of an electronic musical instrument, in which the hammer can be installed correctly by a simple operation of pressing the key.

Solution to the Problem and Effect of the Invention

According to the keyboard device of the electronic musical instrument of a technical solution of the invention, the following effects are achieved. A key is disposed rotatably on a chassis. A rotation center of the key is set as the rear and the key extends from the rear to the front. A support shaft is disposed on the chassis in front of the rotation center of the key. A hammer is disposed rotatably around the support shaft to rotate in conjunction with the key along with pressing on the front of the key. A retaining hole is formed in the hammer for retaining the support shaft such that the hammer is rotatable, and a guide groove is formed by cutting open the retaining hole on the rear. Here, it is a temporarily secured state where the support shaft is temporarily secured in the guide groove of the retaining hole. A shifting means is provided for shifting from the temporarily secured state to a retained state where the support shaft is retained in the retaining hole. That is, the shifting means presses the hammer in the temporarily secured state toward the rear to shift the hammer to the retained state along with the pressing on the front of the key.

Therefore, for example, if the key is installed and then pressed after the hammer is temporarily secured, the hammer can be shifted to the retained state so as to install the hammer correctly. Accordingly, the hammer can be correctly installed by a simple operation of pressing the key without using a special jig for retaining the support shaft in the retaining hole.

According to the keyboard device of an electronic musical instrument of another technical solution of the invention, in addition to the aforementioned effects, the following effects are achieved. A protrusion protrudes from the key toward the hammer. A first contact part is formed on a side surface of the rear of the protrusion to be in contact with the hammer in the temporarily secured state. A first contacted part is formed on the hammer to be in contact with the first contact part of the protrusion. At least one of the first contact part of the protrusion and the first contacted part of the hammer is inclined downward from the rear to the front.

Therefore, if the key is pressed when the hammer is in the temporarily secured state, the first contact part of the protrusion slides obliquely downward from the rear to the front along the first contacted part of the hammer and the first contacted part of the hammer is pressed obliquely downward from the front to the rear by the first contact part of the protrusion (in a direction intersecting the sliding direction of the first contact part of the protrusion). In this case, since at least one of the first contact part of the protrusion and the first contacted part of the hammer is inclined downward from the rear to the front, the direction of the force that the first contact part of the protrusion applies on the first contacted part of the hammer can be changed to a rearward component in the horizontal direction and a downward component in the vertical direction. Accordingly, the support shaft temporarily secured in the guide groove can be pushed into the retaining hole by the rearward component in the horizontal direction to shift the hammer in the temporarily secured state to the retained state.

Moreover, the key is regarded as a "lever" and the "principle of leverage" is utilized with the rotation center of the key as the fulcrum, the front of the pressed key as the force point, and the portion where the first contact part of the protrusion presses the first contacted part of the hammer as the action point. Thus, the hammer can be shifted from the temporarily secured state to the retained state by a small force.

According to the keyboard device of an electronic musical instrument of another technical solution of the invention, in addition to the aforementioned effects, the following effects are achieved. The first contact part of the protrusion and the first contacted part of the hammer are separated from each other when the hammer is in the retained state. Therefore, the first contacted part of the hammer is not pressed by the first contact part of the protrusion even if the key is pressed when the hammer is in the retained state. Accordingly, the hammer in the retained state can be rotated smoothly in conjunction with the key, independently of the first contact part of the protrusion and the first contacted part of the hammer.

According to the keyboard device of an electronic musical instrument of another technical solution of the invention, in addition to the aforementioned effects, the following effects are achieved. The protrusion protruding from the key protrudes from a position in front of the support shaft. A second contact part is formed on a tip part of the protrusion. Because the second contact part of the protrusion is in contact with the hammer in the retained state, if the key is operated when the hammer is in the retained state, the hammer is rotated in conjunction with the key through the second contact part of the protrusion. On the other hand, because the second contact part of the protrusion is separated from the hammer in the temporarily secured state, the hammer is not pressed by the second contact part of the protrusion even if the key is pressed when the hammer is in the temporarily secured state. Accordingly, the hammer in the temporarily secured state can be shifted smoothly to the retained state, independently of the second contact part of the protrusion. In addition to the function of shifting the hammer in the temporarily secured state to the retained state, the protrusion further has the function of rotating the hammer in the retained state in conjunction with the key. Therefore, the parts can be standardized and the costs of the keyboard device can be reduced.

According to the keyboard device of an electronic musical instrument of another technical solution of the invention, when the hammer is in the temporarily secured state, if the front of the key is pressed to shift the hammer to the retained state, the first contacted part is pressed obliquely downward and rearward by a force by the first contact part, by which the hammer is pressed rearward, and when the center of the support shaft is pressed to a position in front of a front end part of the guide groove, the support shaft is fitted into the retaining hole.

According to the keyboard device of an electronic musical instrument of another technical solution of the invention, the guide groove has a tapered shape that is tapered from the rear toward the retaining hole, and a minimum width of the guide groove is smaller than a diameter of the support shaft.

According to the keyboard device of an electronic musical instrument of another technical solution of the invention, the hammer has an inclined surface that descends on a rear of the guide groove such that the support shaft is kept in the temporarily secured state.

According to the keyboard device of an electronic musical instrument of another technical solution of the invention, a rear of the hammer behind the support shaft is heavier than a front of the hammer.

According to the keyboard device of an electronic musical instrument of another technical solution of the invention, at least one of the first contact part of the protrusion and the first contacted part of the hammer is inclined downward to form an inclination angle and the inclination angle is 22 degrees with respect to the vertical direction.

According to the keyboard device of an electronic musical instrument of another technical solution of the invention, the support shaft protrudes from a sub-chassis of the chassis. When the sub-chassis is injection-molded, a parting line is formed on the sub-chassis at a joint portion of a mold, and the parting line is formed in the front-rear direction at the same height as the center of the support shaft.

According to the keyboard device of an electronic musical instrument of another technical solution of the invention, the guide groove is rotatable with respect to the parting line such that the guide groove is inclined obliquely downward and rearward with respect to the parting line when the key is released and extends in the front-rear direction in parallel to the parting line when the key is pressed.

According to the keyboard device of an electronic musical instrument of another technical solution of the invention, in addition to the aforementioned effects, the following effects are achieved. A protrusion is formed on the key and protrudes from a position in front of the support shaft toward the hammer. A third contact part is formed on a tip part of the protrusion to be in contact with the hammer in the temporarily secured state. A guide member is fixed to the chassis and located obliquely downward and forward with respect to the third contact part of the protrusion. A fourth contact part is formed on the guide member to be in contact with the hammer in the temporarily secured state. A fourth contacted part is formed on the hammer to be in contact with the fourth contact part of the guide member. At least one of the fourth contact part of the guide member and the fourth contacted part of the hammer is inclined downward from the front to the rear.

Therefore, if the key is pressed when the hammer is in the temporarily secured state, the hammer is pressed downward by the third contact part of the protrusion. Then, the fourth contacted part of the hammer slides obliquely downward from the front to the rear along the fourth contact part of the guide member and is pressed obliquely upward from the front to the rear by the fourth contact part of the guide member (in a direction intersecting the sliding direction of the fourth contacted part of the hammer). That is, the hammer is pressed by a resultant force of the force pressed downward by the third contact part of the protrusion and the force applied by pressing the fourth contact part of the guide member.

Here, since at least one of the fourth contact part of the guide member and the fourth contacted part of the hammer is inclined downward from the front to the rear, the direction of the force that the fourth contact part of the guide member applies on the fourth contacted part of the hammer can be changed to a rearward component in the horizontal direction and a upward component in the vertical direction. Moreover, since the third contact part of the protrusion presses the hammer substantially downward, the force by which the third contact part of the protrusion presses the hammer substantially downward is substantially equal to the upward component of the force, pressed by the fourth contact part of the guide member, in the vertical direction. Therefore, the resultant force of the force pressed downward by the third contact part of the protrusion and the force pressed by the fourth contact part of the guide member is substantially equal to the rearward component of the force, pressed by the fourth contact part of the guide member, in the horizontal direction. Accordingly, the support shaft temporarily secured in the guide groove can be pushed into the retaining hole by the rearward component in the horizontal direction to shift the hammer in the temporarily secured state to the retained state.

Moreover, the key is regarded as a "lever" and the "principle of leverage" is utilized with the rotation center of the key as the fulcrum, the front of the pressed key as the force point, and the portions where the third contact part of the protrusion and the fourth contact part of the guide member press the hammer as the action point. Thus, the hammer can be shifted from the temporarily secured state to the retained state by a small force.

According to the keyboard device of an electronic musical instrument of another technical solution of the invention, in addition to the aforementioned effects, the following effects are achieved. The third contact part of the protrusion is in contact with the hammer in the temporarily secured state and in contact with the hammer in the retained state. In addition, the fourth contact part of the guide member and the fourth contacted part of the hammer are in contact with each other when the hammer is in the temporarily secured state and separated from each other when the hammer is in the retained state. Therefore, if the key is operated when the hammer is in the retained state, the hammer is rotated in conjunction with the key through the third contact part of the protrusion, but in this case, the fourth contacted part of the hammer is not pressed by the fourth contact part of the guide member. That is, the hammer in the retained state can be rotated smoothly in conjunction with the key, independently of the fourth contact part of the guide member and the fourth contacted part of the hammer. In addition to the function of shifting the hammer in the temporarily secured state to the retained state, the protrusion further has the function of rotating the hammer in the retained state in conjunction with the key. Therefore, the parts can be standardized and the costs of the keyboard device can be reduced.

According to the keyboard device of an electronic musical instrument of another technical solution of the invention, when the hammer is in the temporarily secured state, if the front of the key is pressed to shift the hammer to the retained state, the hammer is pressed rearward by a resultant force of a force that is pressed downward by the third contact part and a force that the fourth contact part presses the fourth contacted part obliquely upward and rearward, and the center of the support shaft is pressed to a position in front of the front end part of the guide groove to fit the support shaft into the retaining hole.

According to the keyboard device of an electronic musical instrument of another technical solution of the invention, at least one of the fourth contact part of the guide member and the fourth contacted part of the hammer is inclined downward to form an inclination angle and the inclination angle is 27 degrees with respect to the vertical direction.

BRIEF DESCRIPTION OF THE DRAWINGS

FIG. 1(*b*) is a cross-sectional view showing the state where the keyboard device of the first embodiment shown in FIG. 1(*a*) is pressed.

FIG. 2(*b*) is a cross-sectional view along the section line IIb-IIb of FIG. 2(*a*).

FIG. 3(*b*) is a cross-sectional view enlarging the main part of FIG. 3(*a*).

FIG. 4(*b*) is a cross-sectional view showing the state where the keyboard device of the second embodiment shown in FIG. 4(*a*) is pressed.

FIG. 5(*b*) is a cross-sectional view enlarging the main part of FIG. 5(*a*).

DESCRIPTION OF THE EMBODIMENTS

Figure 1A:
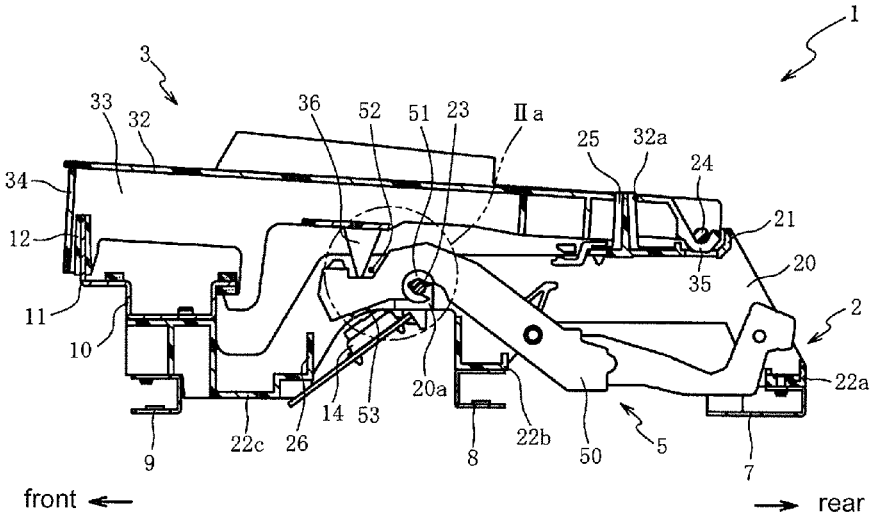
FIG. 1(*a*) is a cross-sectional view of the keyboard device of the first embodiment and particularly shows the case where the hammer is in the retained state.
Figure 1B:
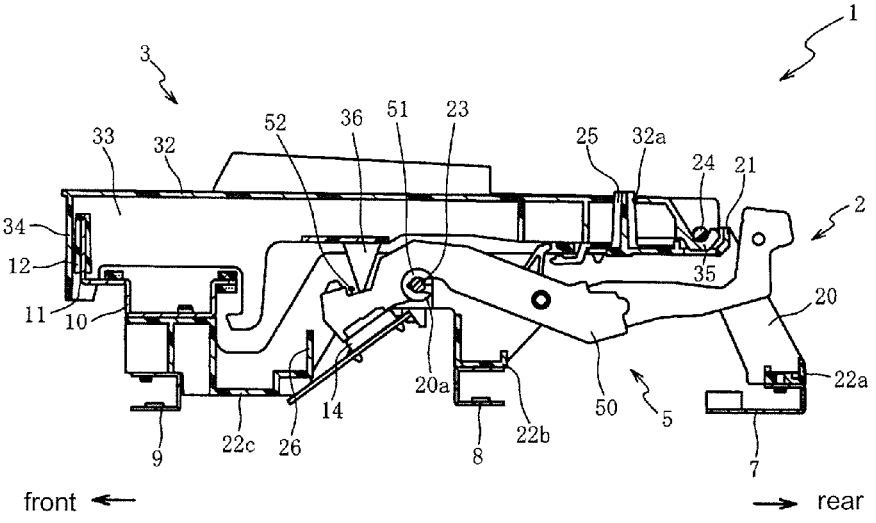

Hereinafter exemplary embodiments of the invention are described with reference to the affixed figures. FIG. 1(*a*) is a cross-sectional view of a keyboard device 1 of the first embodiment and particularly shows the case where a hammer 5 is in a retained state. FIG. 1(*b*) is a cross-sectional view showing the state where the keyboard device 1 shown in FIG. 1(*a*) is pressed. The case where the hammer 5 is in the retained state refers to a state that a hammer support shaft 23 is retained (pivotally supported) by a bearing 51 of the hammer 5. Moreover, in this embodiment, in the longitudinal direction of a key 3, the side of a key support shaft 24, which is the center of rotation of the key 3, is the rear and the side opposite thereto is the front.

The keyboard device 1 is a device disposed in an electronic musical instrument to output a signal corresponding to the operation of the key 3. In particular, with the keyboard device 1, the hammer 5 can be correctly installed by a simple operation of pressing the key 3. In addition, the electronic musical instrument equipped with the keyboard device 1 is an electronic piano, an electronic organ, an electronic keyboard, or a synthesizer, for example.

The keyboard device 1 mainly includes a chassis 2, the key 3, and the hammer 5. The key 3 is disposed rotatably around the key support shaft 24 that protrudes from the chassis 2. The hammer 5 is disposed rotatably around the hammer support shaft 23 in conjunction with the key 3.

The chassis 2 is a unit that forms the skeleton of the keyboard device 1 and is formed of a resin material. The chassis 2 is formed by block units having a predetermined width in a direction (referred to as the width direction hereinafter), along which a plurality of the keys 3 (not shown) are arranged in parallel. Each block includes a chassis body 20, a chassis upper wall 21 formed at the top of the chassis body 20, and chassis bottom walls 22*a* to 22*c* formed at the bottom of the chassis body 20.

The chassis body 20 extends in the front-rear direction under the key 3. A plurality of the chassis bodies 20 are arranged in parallel to sandwich the hammer 5 in the width direction. The chassis upper wall 21 is connected to the chassis body 20 at the rear of the key 3. On the chassis upper wall 21, the key support shaft 24 and a rear guide 25 are disposed side by side in the front-rear direction.

The key support shaft 24 is the center of rotation of the key 3 and is provided for each key 3. The key 3 has an upper wall 32, a pair of side walls 33, and a front wall 34, which form a substantially n-shaped cross section that is open on the lower side, wherein the side walls 33 hang down from two edges of the upper wall 33 that extend in the front-rear direction, and the front wall 34 hangs down from the front end of the upper wall 32. A hook 35 is disposed continuously with the rear end of the side walls 33, and the key support shaft 24 is hooked by the hook 35. In this way, the key 3 is disposed rotatably around the key support shaft 24.

The rear guide 25 suppresses the key 3 from wobbling and is provided for each key 3. The rear guide 25 is disposed upright on the chassis upper wall 21 and passes through a through hole 32*a* that is formed in the upper wall 32 of the key 3, and thus can suppress wobbling of the key 3.

The chassis bottom walls 22*a* to 22*c* bridge the chassis bodies 20 that are adjacent in the width direction. The rigidity of the chassis body 20 is enhanced by the chassis bottom walls 22*a* to 22*c*. Metallic base members 7 to 9 having an n-shaped cross section are fixed to the lower sides of the chassis bottom walls 22*a* to 22*c*. The rigidity of the chassis 2 is enhanced by the base members 7 to 9. A metal part 10, made of a metal, is fixed to the upper side of the chassis bottom wall 22*c*.

A front guide 11 is disposed upright in front of the metal part 10. The front guide 11 extends between the pair of side walls 33 of the key 3 from the lower side of the key 3 and therefore can suppress the key 3 from wobbling in the width direction. Moreover, the front guide 11 is covered by a cover 12 made of an elastic member, such as rubber or elastomer, and therefore can absorb the impact when the side wall 33 of the key 3 collides with the front guide 11. Further, a lubricant such as grease is applied on the outer peripheral surface of the cover 12 to facilitate sliding between the cover 12 and the key 3.

The key 3 is disposed above the chassis body 20 and is formed of a resin material. A protrusion 36 having a substantially pointed shape is disposed in a substantially central portion of the key 3 in the front-rear direction (in front of the hammer support shaft 23) to protrude toward the hammer 5. The tip of the protrusion 36 is in contact with the hammer 5. The key 3 can be lifted up by the hammer 5 through the protrusion 36 at the time of key release (see FIG. 1(*a*)) and press down the hammer 5 through the protrusion 36 at the time of key pressing (see FIG. 1(*b*)).

The hammer 5 imparts the key 3 a touch weight similar to that of an acoustic piano. The hammer 5 is disposed under the key 3 and has a structure formed by insert-molding a metal member in a resin material. The rear of the hammer 5 behind the hammer support shaft 23 is heavier than the front of the hammer 5.

The hammer 5 mainly includes a hammer body 50 and a bearing 51, wherein the hammer body 50 extends in the front-rear direction, and the bearing 51 is integrally formed with the hammer body 50 in the middle of the hammer body 50. A concave part 52, into which the tip part of the protrusion 36 is inserted, is recessed on the hammer body 50. A switch protrusion 53 protrudes from the outer peripheral surface on the lower side of the concave part 52. A switch 14 is fixed to the chassis body 20 through a substrate at a position facing the switch protrusion 53. The switch 14 is for detecting information related to the operation of the key 3 (key pressing operation, key pressing speed, and so on) through the switch protrusion 53.

The bearing 51 retains (pivotally supports) the hammer support shaft 23. The hammer support shaft 23 protrudes from a sub-chassis 20*a* of the chassis body 20. With the hammer support shaft 23 retained by the bearing 51, the hammer 5 is disposed rotatably around the hammer support shaft 23.

Because of such a configuration, the hammer 5 is rotated counterclockwise around the hammer support shaft 23 against its own weight when the key is pressed (FIG. 1(*a*)→FIG. 1(*b*)) and can give the key 3 a touch weight. In addition, the switch 14 can be turned ON by the switch protrusion 53 to detect the key pressing operation and the key pressing speed.

Further, the hammer 5 is rotated clockwise around the hammer support shaft 23 by its own weight when the key is released (FIG. 1(*b*)→FIG. 1(*a*)) to lift up the key 3 through the protrusion 36, such that the key 3 can return to the initial position. In addition, the switch 14 can be turned OFF by the switch protrusion 53 to detect the key release operation.

Figure 2B:
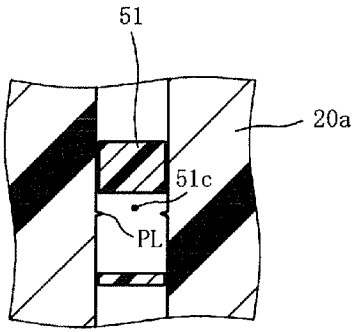
FIG. 2(*a*) is a cross-sectional view enlarging the portion IIa of FIG. 1(*a*).
Figure 2:
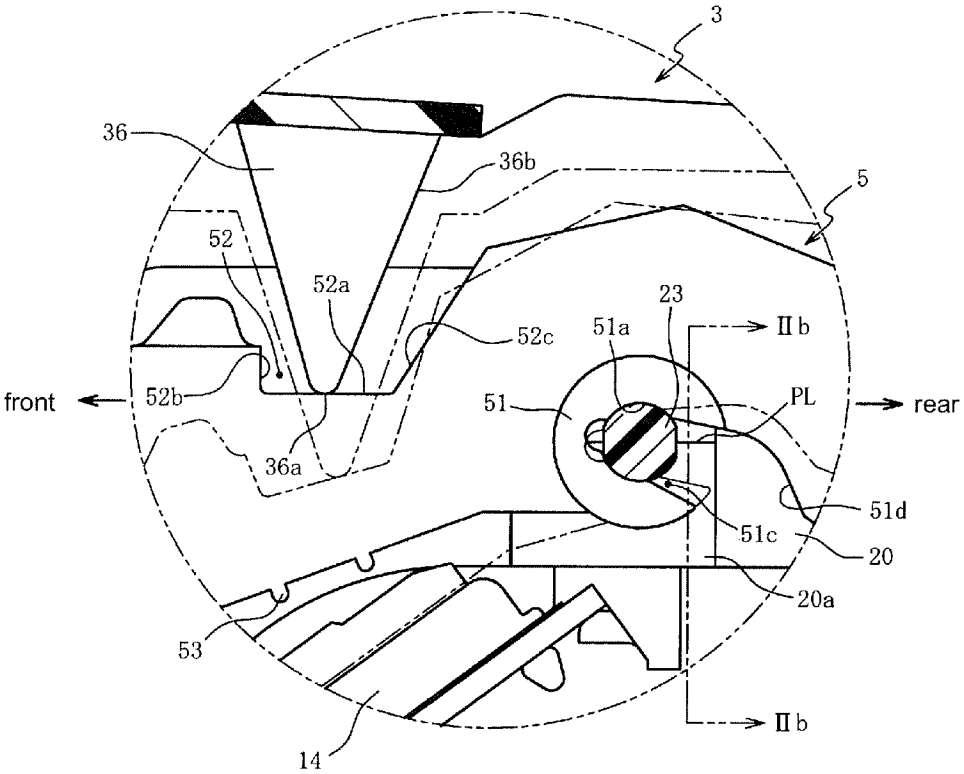

Next, the protrusion 36 of the key 3, the concave part 52 of the hammer 5, and the bearing 51 of the hammer 5 described above are explained in detail with reference to FIG. 2(*a*) and FIG. 2 (*b*). FIG. 2(*a*) is a cross-sectional view enlarging the portion IIa of FIG. 1(*a*). FIG. 2(*b*) is a cross-sectional view along the section line IIb-IIb of FIG. 2(*a*). In FIG. 2(*a*), the key 3 and the hammer 5 during key pressing are indicated by the two-dot chain lines.

The tip part of the protrusion 36 of the key 3 is inserted into the concave part 52 of the hammer 5. The concave part 52 of the hammer 5 is surrounded by a bottom surface 52*a*, a first side surface 52*b*, and a second side surface 52*c*. The bottom surface 52*a* extends substantially horizontally and the tip 36*a* of the protrusion 36 is in contact with the bottom surface 52*a*. The first side surface 52*b* extends upward from the front of the bottom surface 52*a*. The second side surface 52*c* extends upward from the rear of the bottom surface 52*a*.

The tip 36*a* of the protrusion 36 is in contact with substantially the center of the bottom surface 52*a* of the concave part 52 when the key is released (see the solid lines in FIG. 2(*a*)). When the key is pressed (see the solid lines→two-dot chain lines in FIG. 2(*a*)), the tip 36*a* of the protrusion 36 slides toward the rear (the side of the second side surface 52*c* of the concave part 52) along the bottom surface 52*a* of the concave part 52 and presses the hammer 5 substantially downward. In this way, the hammer 5 rotates counterclockwise around the hammer support shaft 23. When the key is released (see the two-dot chain lines→solid lines in FIG. 2(*a*)), the hammer 5 rotates clockwise around the hammer support shaft 23 and the tip 36*a* of the protrusion 36 slides toward the side of the first side surface 52*b* of the concave part 52 and is moved to substantially the center of the bottom surface 52*a* of the concave part 52.

As described above, when the hammer 5 is in the retained state, a side surface 36*b* of the protrusion 36 (the side surface on the rear of the protrusion 36) and the second side surface 52*c* of the concave part 52 are at positions away from each other during key pressing (two-dot chain lines in FIG. 2(*a*)) and key release (solid lines in FIG. 2(*a*)). That is, when the hammer 5 is in the retained state, even though the tip part of the protrusion 36 is inserted into the concave part 52, the side surface 36*b* of the protrusion 36 and the second side surface 52*c* of the concave part 52 do not interfere with each other regardless of the operation of the key 3, so as to make the rotation of the hammer 5 smooth.

The bearing 51 has a C-shaped cross section. A retaining hole 51*a* and a guide groove 51*c* are formed in the bearing 51. The retaining hole 51*a* passes through the center of the bearing 51, and the hammer support shaft 23 is retained in the retaining hole 51*a*. The state where the hammer support shaft 23 is retained in the retaining hole 51 a is the retained state.

The guide groove 51*c* is for guiding the hammer support shaft 23 in the retaining hole 51*a* and is formed by cutting open the retaining hole 51*a* on the rear. The guide groove 51*c* has a shape that is tapered from the rear toward the retaining hole 51 a. The minimum width of the guide groove 51*c* is smaller than the diameter of the hammer support shaft 23. Therefore, it is possible to prevent the hammer support shaft 23 retained in the retaining hole 51 a from falling out of the retaining hole 51 a. In other words, the guide groove 51*c* can temporarily secure the hammer support shaft 23. During manufacturing, the hammer support shaft 23 is temporarily secured in the guide groove 51*c*, and in this temporarily secured state, the key 3 is installed and then pressed, such that the hammer 5 can be shifted from the temporarily secured state to the retained state. Details will be described later. Moreover, an inclined surface 51*d* that descends is formed on a rear of the guide groove 51*c* for keeping the support shaft 23 in the temporarily secured state. The inclined surface 51*d* can prevent the support shaft 23 from greatly deviating from the temporarily secured position.

In addition, the guide groove 51*c* is rotatable in a range facing a parting line PL. In the case where the sub-chassis 20*a* is injection-molded, the parting line PL is formed at the joint portion of the mold. The parting line PL is formed in the front-rear direction at the same height as the center of the hammer support shaft 23. As shown in FIG. 2(*b*), the parting line PL protrudes slightly from the inner surface of the sub-chassis 20*a*. Depending on the location, the protrusion amount may be larger and burrs may occur easily.

The guide groove 51*c* is somewhat inclined obliquely downward and rearward with respect to the parting line PL when the key is released (see the solid lines in FIG. 2(*a*)) and extends in the front-rear direction substantially in parallel to the parting line PL when the key is pressed (see the two-dot chain lines in FIG. 2(*a*)). In other words, the guide groove 51*c* is rotatable in the range facing the parting line PL. Therefore, even if the hammer 5 (bearing 51) rotates around the hammer support shaft 23, it is possible to extremely prevent the parting line PL from hitting the hammer 5 (bearing 51) and hindering rotation of the hammer 5 as much as possible.

Figure 3A:
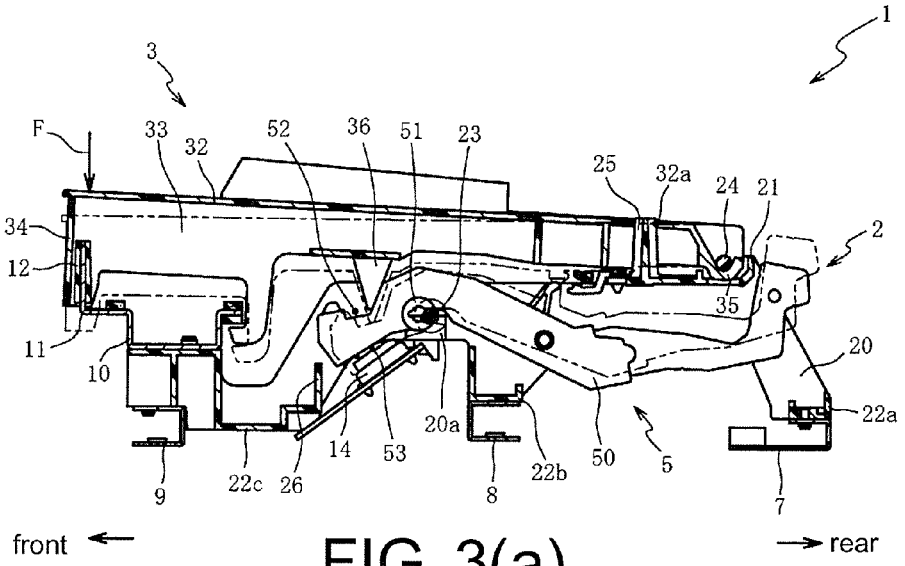
FIG. 3(*a*) is a cross-sectional view of the keyboard device of the first embodiment and particularly shows the case where the hammer is in the temporarily secured state.
Figure 3B:
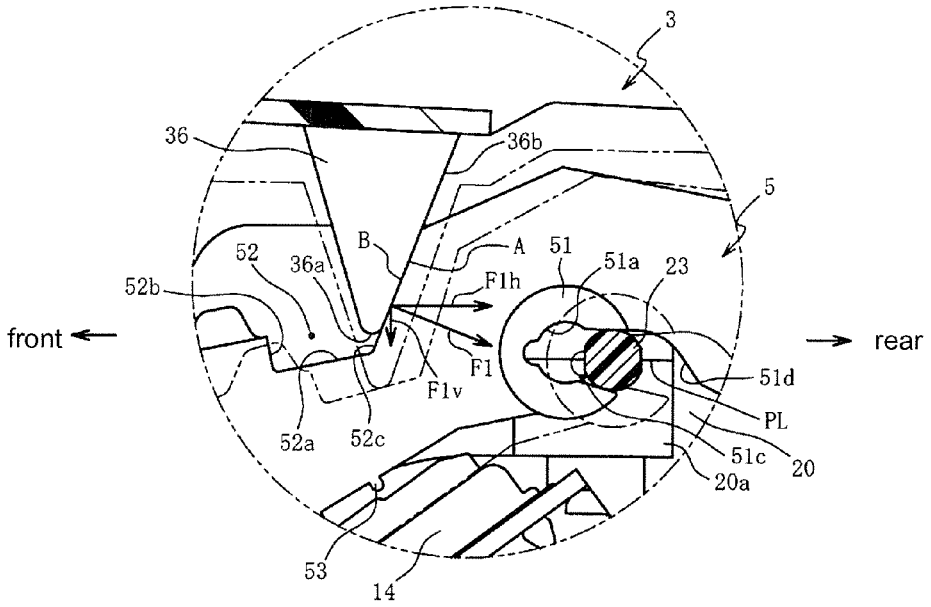

FIG. 3(*a*) is a cross-sectional view of the keyboard device 1 and particularly shows the case where the hammer 5 is in the temporarily secured state. FIG. 3(*b*) is a cross-sectional view enlarging the main part of FIG. 3(*a*). Further, in contrast to the hammer 5 in the temporarily secured state (see the solid lines), FIG. 3(*a*) and FIG. 3 (*b*) illustrates the key 3 that is pressed and the hammer 5 that is shifted from the temporarily secured state to the retained state due to the key pressing operation by two-dot chain lines.

The case where the hammer 5 is in the temporarily secured state refers to a state that the hammer support shaft 23 is temporarily secured in the guide groove 51*c*. As described above, the guide groove 51*c* has the shape that is tapered from the rear toward the retaining hole 51*a*, and the minimum width of the guide groove 51*c* is smaller than the diameter of the hammer support shaft 23. Thus, specifically, the case where the hammer 5 is in the temporarily secured state refers to a state that the center of the hammer support shaft 23 is temporarily secured (press-fitted) in the middle of the guide groove 51*c* behind the portion of the minimum width of the guide groove 51*c* (front end part of the guide groove 51*c*).

In the manufacturing process of the keyboard device 1, the hammer support shaft 23 is temporarily secured in the guide groove 51*c* such that the guide groove 51*c* is rearward with respect to the retaining hole 51 a and the guide groove 51*c* is substantially parallel to the parting line PL (the guide groove 51*c* extends substantially in the front-rear direction). Then, the key 3 is installed during the temporarily secured state. FIG. 3(*a*) and FIG. 3 (*b*) illustrates this state (see the solid lines).

In the keyboard device 1, the protrusion 36 and the hammer 5 are formed with parts to be in contact with each other for shifting the hammer 5 from the temporarily secured state to the retained state when the hammer 5 is in the temporarily secured state. That is, a protrusion side contact part A is formed on the protrusion 36 to be in contact with a hammer side contact part B, and the hammer side contact part B is formed on the hammer 5 to be in contact with the protrusion side contact part A.

Specifically, as shown in FIG. 3(*b*), the protrusion side contact part A is formed on a lower portion of the side surface 36*b* of the protrusion 36, and the hammer side contact part B is formed on an upper portion of the second side surface 52*c* of the concave part 52. In addition, the protrusion side contact part A and the hammer side contact part B are inclined obliquely downward and forward. The inclination angle is about 22 degrees with respect to the vertical direction.

Therefore, when the hammer 5 is in the temporarily secured state, if the front of the key 3 is pressed by a force F (see the arrow F in FIG. 3(*a*)), the protrusion side contact part A slides obliquely downward and forward along the hammer side contact part B and the hammer side contact part B is pressed obliquely downward and rearward by a force F1 by the protrusion side contact part A (see the arrow F1 in FIG. 3(*b*)). In this case, since the protrusion side contact part A and the hammer side contact part B are formed to be inclined obliquely downward and forward, the direction of the exerted force F1 can be changed to a force F1*h* (see the arrow F1*h* in FIG. 3(*b*)) and a force F1*v* (see the arrow F1*v* in FIG. 3(*b*)), wherein the force F1*h* is the rearward component in the horizontal direction and the force F1*v* is the downward component in the vertical direction. That is, the hammer 5 in the temporarily secured state can be pressed rearward by the force F1*h*, which is the rearward component of the force F1 in the horizontal direction.

Thus, when the hammer 5 is pressed rearward and the center of the hammer support shaft 23 is pressed to the position in front of the portion of the minimum width of the guide groove 51*c* (front end part of the guide groove 51*c*), the pressure of the bearing 51 (guide groove 51*c*) that has been temporarily securing the hammer support shaft 23 decreases. Therefore, the hammer 5 is knocked rearward (the hammer side contact part B is separated from the protrusion side contact part A) and the hammer support shaft 23 is retained (fitted) in the retaining hole 50*a*.

That is, the protrusion side contact part A is in contact with the hammer side contact part B and presses the hammer 5 rearward until the center of the hammer support shaft 23 comes to the position in front of the portion of the minimum width of the guide groove 51*c* (front end part of the guide groove 51*c*), and then is separated from the hammer side contact part B. On the other hand, when the hammer 5 is in the temporarily secured state, the tip 36*a* of the protrusion 36 and the bottom surface 52*a* of the concave part 52 are separated from each other based on the relationship that the protrusion side contact part A is in contact with the hammer side contact part B. Nevertheless, the tip 36*a* of the protrusion 36 and the bottom surface 52*a* of the concave part 52 come in contact with each other when the protrusion side contact part A is separated from the hammer side contact part B (when the hammer support shaft 23 is retained in the retaining hole 50*a*).

In this way, the hammer 5 in the temporarily secured state (see the solid lines in FIG. 3(*a*) and FIG. 3 (*b*)) is shifted to the retained state (see the two-dot chain lines in FIG. 3(*a*) and FIG. 3 (*b*)) by the protrusion side contact part A and the hammer side contact part B along with the pressing on the key 3, and then the hammer 5 in the retained state is rotated in conjunction with the key 3 through the protrusion 36.

Thus, in the manufacturing process of the keyboard device 1, if the key 3 is installed and then pressed after the hammer 5 is temporarily secured, the hammer 5 in the temporarily secured state can be shifted to the retained state, so as to install the hammer 5 correctly. Accordingly, the hammer 5 can be correctly installed by a simple operation of pressing the key 3 without using a special jig for retaining the hammer support shaft 23 in the retaining hole 50*a*.

Further, in the manufacturing process of the keyboard device 1, the key pressing operation may be performed to press the key 3 several times after the key 3 is installed, so as to confirm the operation of the installed key 3 and so on. Thereby, since the hammer 5 can be installed correctly in accordance with the key pressing operation, the manufacturing process of the keyboard device 1 can be done more efficiently.

Moreover, the key 3 is regarded as a "lever" and the "principle of leverage" is utilized with the center of rotation of the key 3 (the center of the key support shaft 24) as the fulcrum, the pressed portion of the key 3 (see the arrow F in FIG. 3(*a*)) as the force point, and the portion where the protrusion side contact part A presses the hammer side contact part B as the action point. Thus, it is possible to shift the hammer 5 from the temporarily secured state to the retained state by a small force. Accordingly, the hammer 5 can be correctly installed by a simple operation of pressing the key 3 without using a special jig for retaining the hammer support shaft 23 in the retaining hole 50*a*.

In addition, the protrusion side contact part A is formed on the protrusion 36. As described above, the protrusion 36 has the function of rotating the hammer 5 in conjunction with the key 3 when the hammer 5 is in the retained state. That is, because the protrusion side contact part A is formed on the protrusion 36 that has such a function, the protrusion 36 can be used for rotating the hammer 5 in conjunction with the key 3 as well as shifting the hammer 5 in the temporarily secured state to the retained state. Thus, the parts can be standardized and the costs of the keyboard device 1 can be reduced.

Moreover, as shown in FIG. 3(*b*), the tip 36*a* of the protrusion is separated from the hammer 5 (the bottom surface 52*a* of the concave part 52) in the temporarily secured state. Thus, even if the key 3 is pressed when the hammer 5 is in the temporarily secured state, the hammer 5 is not pressed by the tip 36*a* of the protrusion 36. Accordingly, the hammer 5 in the temporarily secured state can be shifted smoothly to the retained state, independently of the tip 36*a* of the protrusion 36.

In addition, both the protrusion side contact part A and the hammer side contact part B are inclined obliquely downward and forward, and thus the hammer 5 can be pressed throughout the section where the protrusion side contact part A and the hammer side contact part B contact each other. Thus, by forming one of the protrusion side contact part A and the hammer side contact part B into a pointed shape toward the other and partially pressing the hammer with the tip of the pointed shape, for example, it is possible to prevent the hammer 5 from rotating with the temporarily secured hammer support shaft 23 as the fulcrum. Accordingly, the hammer 5 can definitely be pressed rearward to push the hammer support shaft 23 temporarily secured in the guide groove 51*c* into the retaining hole 50*a*.

Furthermore, the state of the electronic musical instrument equipped with the keyboard device 1 as shown in FIG. 3(*a*) and FIG. 3(*b*) is not necessarily made intentionally by the operator during the manufacturing process. For example, if the user inadvertently drops the electronic musical instrument with the hammer 5 set to the retained state, the impact may cause the electronic musical instrument to become the state shown in FIG. 3(*a*) and FIG. 3(*b*).

In that case, it is required to reinstall the hammer 5. Conventionally, a special jig has been used for installation of the hammer 5. For the user who does not have the special jig, the repair has to be done by the manufacturer and so on. However, according to the electronic musical instrument equipped with the keyboard device 1 of this application, the hammer 5 can be installed correctly again by the simple operation of pressing the key 3. Therefore, the repair does not need to be done by the manufacturer, which is convenient.

Figure 4A:
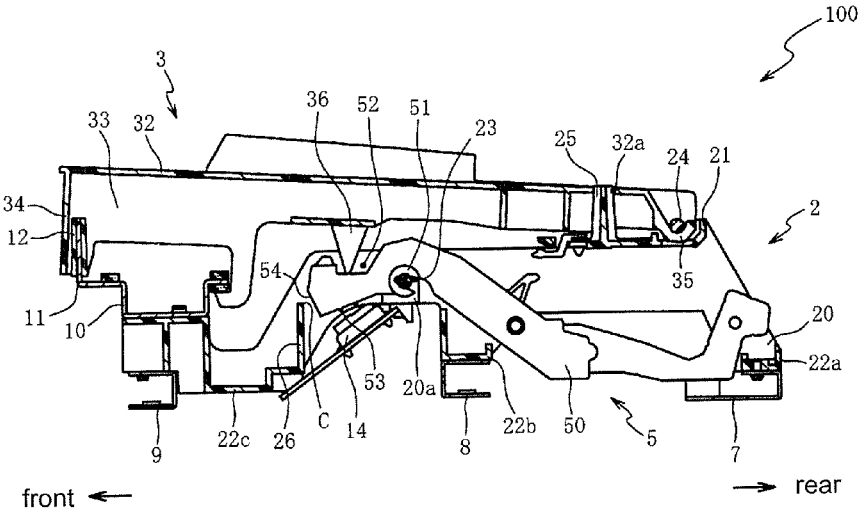
FIG. 4(*a*) is a cross-sectional view of the keyboard device of the second embodiment and particularly shows the case where the hammer is in the temporarily secured state.
Figure 4B:
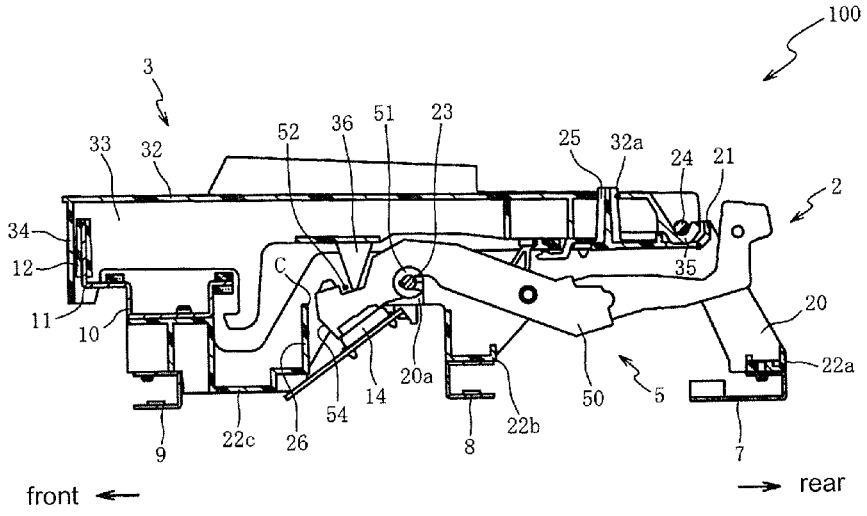

FIG. 4(*a*) is a cross-sectional view of a keyboard device 100 of the second embodiment and particularly shows the case where the hammer 5 is in the retained state. FIG. 4(*b*) is a cross-sectional view showing the state where the keyboard device 100 shown in FIG. 4(*a*) is pressed. In addition, components the same as those of the keyboard device 1 of the first embodiment are assigned with the same reference numerals. Thus, detailed descriptions thereof are not repeated hereinafter.

The keyboard device 100 of the second embodiment is a device that shifts the hammer 5 in the temporarily secured state to the retained state through the key pressing operation by forming the parts, which are in contact with each other when the hammer 5 is in the temporarily secured state, on a vertical wall 26 (a portion of the chassis bottom wall 22*c*) and the hammer 5.

Therefore, the keyboard device 100 differs from the first embodiment in that the vertical wall 26, which is erected upward from the rear of the chassis bottom wall 22*c*, extends above the vertical wall 26 of the first embodiment. That is, the keyboard device 100 shifts the hammer 5 in the temporarily secured state to the retained state through the key pressing operation by forming a vertical wall side contact part C on the upper rear portion of the vertical wall 26 and bringing the vertical wall side contact part C in contact with the side surface 54 of the hammer 5 (the surface that is inclined obliquely downward and rearward in front of the hammer 5).

However, when the hammer 5 is in the retained state, the vertical wall side contact part C and the side surface 54 of the hammer 5 are at positions away from each other no matter the key 3 is pressed (see FIG. 4(*b*)) or released (see FIG. 4(*a*)). Therefore, the vertical wall side contact part C and the side surface 54 of the hammer do not interfere with each other when the hammer 5 is in the retained state, and in the keyboard device 100, the hammer 5 in the retained state can be smoothly rotated in conjunction with the key 3.

Further, the keyboard device 100 differs from the first embodiment in that the concave part 52 of the hammer 5 extends behind the concave part 52 of the first embodiment. For the keyboard device 100, when the hammer 5 is in the temporarily secured state, like the first embodiment, it is not required to make the protrusion side contact part A and the hammer side contact part B in contact with each other.

Figure 5A:
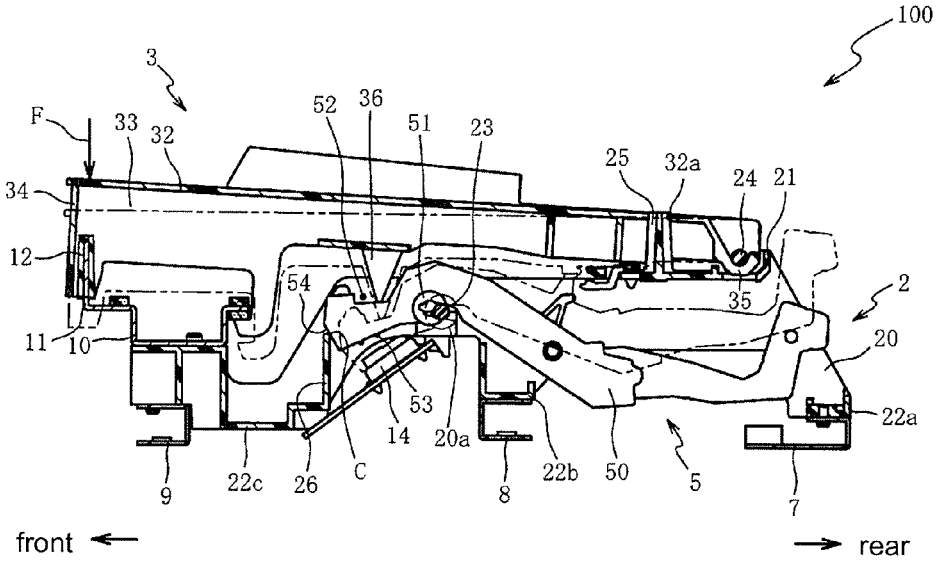
FIG. 5(*a*) is a cross-sectional view of the keyboard device of the second embodiment and particularly shows the case where the hammer is in the temporarily secured state.
Figure 5B:
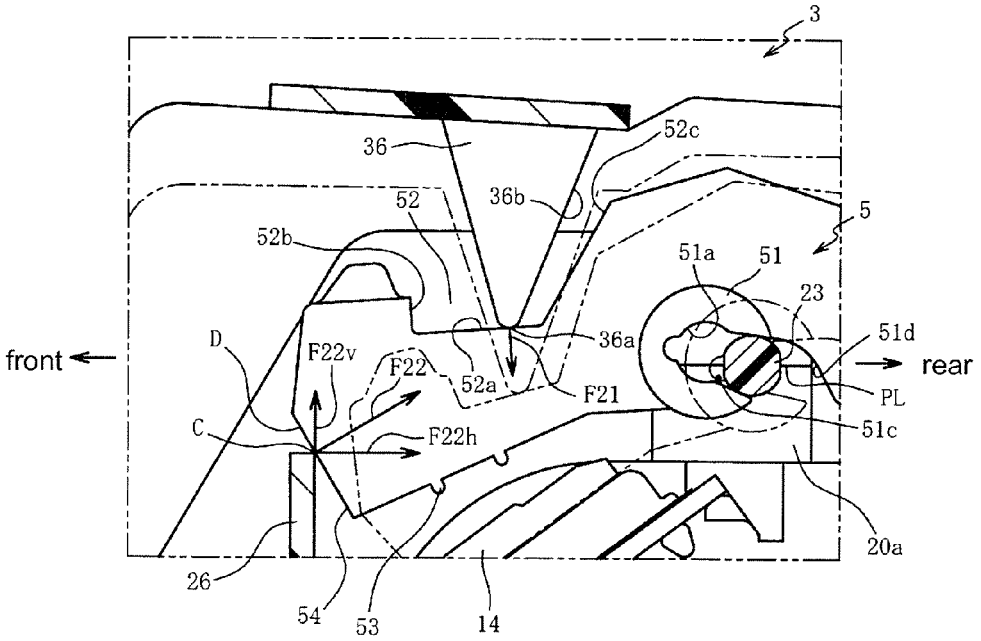

FIG. 5(*a*) is a cross-sectional view of the keyboard device 100 and particularly shows the case where the hammer 5 is in the temporarily secured state. FIG. 5(*b*) is a cross-sectional view enlarging the main part of FIG. 5(*a*). Further, in contrast to the hammer 5 in the temporarily secured state (see the solid lines), FIG. 5(*a*) and FIG. 5(*b*) illustrates the key 3 that is pressed and the hammer 5 that is shifted from the temporarily secured state to the retained state due to the key pressing operation by two-dot chain lines.

The case where the hammer 5 is in the temporarily secured state refers to the state that the hammer support shaft 23 is temporarily secured in the guide groove 51*c*. In the keyboard device 100 of the second embodiment, the guide groove 51*c* is directed slightly obliquely upward and forward compared to that of the first embodiment even when the hammer 5 is in the temporarily secured state as in the keyboard device 1 of the first embodiment.

In the keyboard device 1 of the first embodiment, when the hammer 5 is in the temporarily secured state, as shown in FIG. 3(*b*), the protrusion side contact part A and the hammer side contact part B are in contact, which suppresses the hammer 5 from being lifted up by its own weight.

On the other hand, in the keyboard device 100 of the second embodiment, the side surface 36*b* of the protrusion 36 and the second side surface 52*c* of the concave part 52 are separated from each other when the hammer 5 is in the temporarily secured state. That is, the second side surface 52*c* of the concave part 52 of the second embodiment as shown in FIG. 5(*b*) is formed behind that of the first embodiment. In other words, the bottom surface 52*a* of the concave part 52 further extends rearward compared to the first embodiment.

For this reason, although the keyboard device 100 of the second embodiment have the protrusion side contact part A and the hammer side contact part B, they are not in contact with each other even when the hammer 5 is in the temporarily secured state as in the first embodiment. Thus, due to the own weight of the hammer 5, the guide groove 51*c* is directed slightly obliquely upward and forward compared to that of the first embodiment.

As a consequence, the tip 36*a* of the protrusion 36 and the bottom surface 52*a* of the concave part 52 are separated from each other in the first embodiment as shown in FIG. 3(*b*); and in contrast, the tip 36*a* of the protrusion 36 and the bottom surface 52*a* of the concave part 52 in the keyboard device 100 of the second embodiment are in contact with each other no matter the hammer 5 is in the retained state or the temporarily secured state.

Moreover, as described above, in the keyboard device 100, the vertical wall side contact part C of the vertical wall 26 is brought in contact with the side surface 54 of the hammer 5, so as to shift the hammer 5 in the temporarily secured state to the retained state through the key pressing operation. Specifically, a hammer side contact part D is formed on the side surface 54 of the hammer 5 to be in contact with the vertical wall side contact part C. The hammer side contact part D is inclined obliquely downward and rearward. In addition, the inclination angle of the hammer side contact part D is about 27 degrees with respect to the vertical direction.

Therefore, when the hammer 5 is in the temporarily secured state, if the front of the key 3 is pressed by the force F (see the arrow F in FIG. 5(*a*)), the hammer 5 is pressed substantially downward by a force F21 (see the arrow F21 in FIG. 5(*b*)) by the tip 36*a* of the protrusion. Then, the hammer side contact part D slides obliquely downward and rearward along the vertical wall side contact part C and is pressed obliquely upward and rearward from the vertical wall side contact part C by a force F22 (see the arrow F22 in FIG. 5(*b*)). That is, the hammer 5 is pressed by a resultant force of the force F21 pressed by the tip 36*a* of the protrusion and the force F22 pressed by the vertical wall side contact part C.

Here, since the hammer side contact part D is inclined obliquely downward and rearward, the direction of the force F22 can be changed to a force F22*h* (see the arrow F22*h* in FIG. 5(*b*)) and a force F22*v* (see the arrow F22*v* in FIG. 5(*b*)), wherein the force F22*h* is the rearward component in the horizontal direction and the force F22*v* is the downward component in the vertical direction. Moreover, since the force F21 pressed by the tip 36*a* of the protrusion presses the hammer 5 substantially downward, the force F21 is substantially equal to the force F22*v* (see the arrow F22*v* in FIG. 5(*b*)), which is the upward component of the force F22, pressed by the vertical wall side contact part C, in the vertical direction.

Thus, the resultant force of the force F21 pressed by the tip 36*a* of the protrusion and the force F22 pressed by the vertical wall side contact part C is substantially equal to the force F22*h*, which is the rearward component of the force F22, pressed by the vertical wall side contact part C, in the horizontal direction. Accordingly, the hammer 5 can be pressed rearward by the force F22*h*.

Thereby, when the hammer 5 is pressed rearward and the center of the hammer support shaft 23 is pressed to the position in front of the portion of the minimum width of the guide groove 51*c* (front end part of the guide groove 51*c*), the pressure of the bearing 51 (guide groove 51*c*) that has been temporarily securing the hammer support shaft 23 decreases. Therefore, the hammer 5 is knocked rearward (the hammer side contact part D is separated from the vertical wall side contact part C) and the hammer support shaft 23 is retained (fitted) in the retaining hole 50*a*.

That is, the vertical wall side contact part C is in contact with the hammer side contact part D and presses the hammer 5 rearward until the center of the hammer support shaft 23 comes to the position in front of the portion of the minimum width of the guide groove 51*c* (front end part of the guide groove 51*c*), and then is separated from the hammer side contact part D. In addition, the tip 36*a* of the protrusion 36 and the bottom surface 52*a* of the concave part 52 are in contact with each other no matter the hammer 5 is in the temporarily secured state or the retained state.

In this way, the hammer 5 in the temporarily secured state (see the solid lines in FIG. 5(*a*) and FIG. 5(*b*)) is shifted to the retained state (see the two-dot chain lines in FIG. 5(*a*) and FIG. 5(*b*)) by the tip 36*a* of the protrusion 36 and the vertical wall side contact part C, and the hammer 5 in the retained state is rotated in conjunction with the key 3 through the protrusion 36.

As a result, like the keyboard device 1 of the first embodiment, the keyboard device 100 of the second embodiment can correctly install the hammer 5 by a simple operation of pressing the key 3 without using a special jig for retaining the hammer support shaft 23 in the retaining hole 50*a*.

Moreover, the key 3 is regarded as a "lever" and the "principle of leverage" is utilized with the center of rotation of the key 3 (the center of the key support shaft 24) as the fulcrum, the pressed portion of the key 3 (see the arrow F in FIG. 5(*a*)) as the force point, and the portions where the tip 36*a* of the protrusion 36 and the vertical wall side contact part C press the hammer 5 as the action point. Thus, it is possible to shift the hammer 5 from the temporarily secured state to the retained state by a small force. Accordingly, the hammer 5 can be correctly installed by a simple operation of pressing the key 3 without using a special jig for retaining the hammer support shaft 23 in the retaining hole 50*a*.

Further, as described above, the tip 36*a* of the protrusion 36 has the function of rotating the hammer 5 in conjunction with the key 3 even when the hammer 5 is in the retained state. That is, in addition to such a function, the protrusion 36 has the function of shifting the hammer 5 in the temporarily secured state to the retained state. Thus, the parts can be standardized and the costs of the keyboard device 100 can be reduced.

Furthermore, the vertical wall side contact part C is formed on the vertical wall 26, which is a portion of the chassis bottom wall 22*c*, and the vertical wall 26 bridges the chassis bodies 20 that are adjacent in the width direction. In other words, in addition to the function of reinforcing the chassis bodies 20, the vertical wall 26 further has the function of shifting the hammer in the temporarily secured state to the retained state. Therefore, the vertical wall 26 can provide two functions and the parts can be standardized to reduce the manufacturing costs of the keyboard device 100.

Besides, with respect to the vertical wall side contact part C formed on the upper rear portion of the vertical wall 26, the hammer side contact part D in contact with the vertical wall side contact part C is inclined obliquely downward and rearward. Therefore, the sliding resistance between the vertical wall side contact part C and the hammer side contact part D is small, and the hammer side contact part D can slide smoothly along the vertical wall side contact part C to efficiently utilize the key pressing force to shift the hammer in the temporarily secured state to the retained state.

The above illustrates the invention on the basis of the embodiments. However, it should be understood that the invention is not limited to any of the embodiments, and various modifications or alterations may be made without departing from the spirit of the invention.

In the first embodiment described above, the protrusion 36 is disposed in front of the hammer support shaft 23. However, the position of the protrusion 36 is not limited thereto. For example, the protrusion 36 may remain to rotate the hammer 5 in conjunction with the key 3 when the hammer 5 is in the retained state. Then, a protrusion different from the protrusion 36 may protrude from the key 3, wherein a protrusion side contact part a equivalent to the protrusion side contact part A may be formed on this different protrusion and a hammer side contact part b (the part to be in contact with the protrusion side contact part a) equivalent to the hammer side contact part B may be formed on the hammer 5.

In the first embodiment described above, both the protrusion side contact part A and the hammer side contact part B are inclined obliquely downward and forward. However, the invention is not limited thereto. For example, a portion of one of them may be formed into a pointed shape toward the other one. In such a case, the sliding resistance between the protrusion side contact part A and the hammer side contact part B can be reduced, and the other one of them can slide smoothly along one of them to efficiently utilize the key pressing force to shift the hammer in the temporarily secured state to the retained state.

In the first embodiment described above, the inclination angle of the protrusion side contact part A and the hammer side contact part B with respect to the vertical direction is about 22 degrees, but the inclination angle is not limited thereto. Nevertheless, the inclination angle is preferably 45 degrees or less with respect to the vertical direction. The reason is that, as shown in FIG. 3(*b*), if the inclination angle is 45 degrees or less, the force F1*h*, i.e. the horizontal component of the force F1 (see the arrow F1*h* in FIG. 3(*b*)), would be greater than the force F1*v*, i.e. the vertical component (see the arrow F1*v* of FIG. 3(*b*)), and make it easy to press the hammer 5 rearward. Moreover, the inclination angle is preferably set to make the direction of the force F1 (see the arrow F1 in FIG. 3(*b*)) substantially coincide with the extending direction of the guide groove 51*c*. In such a case, the key pressing force can be efficiently utilized to shift the hammer in the temporarily secured state to the retained state.

Similarly, in the second embodiment described above, the inclination angle between the vertical wall side contact part C and the hammer side contact part D with respect to the vertical direction is about 27 degrees, but the inclination angle is not limited thereto. Nevertheless, the inclination angle is preferably 45 degrees or less with respect to the vertical direction. Moreover, the inclination angle is preferably set to make the direction of the force F22 (see the arrow F22 in FIG. 5(*b*)) substantially coincide with the extending direction of the guide groove 51*c*.

In the second embodiment described above, the vertical wall side contact part C is formed on the upper rear portion of the vertical wall 26 and the hammer side contact part D is inclined obliquely downward and rearward. However, the invention is not limited thereto. For example, the portion of the vertical wall 26 to be in contact with the hammer side contact part D may have an inclined surface that is inclined obliquely downward and rearward, in place of the vertical wall side contact part C. Further, in the case where such an inclined surface is formed, the hammer side contact part D may be formed into a pointed shape toward the inclined surface.

In the first and second embodiments described above, the hammer 5 is rotated in conjunction with the key 3 through the protrusion 36 that protrudes from the key 3. However, the invention is not limited thereto. In place of the protrusion 36, a protrusion that protrudes from the hammer 5 toward the key 3 may be disposed for rotating the hammer 5 in conjunction with the key 3.

What is claimed is:

1. A keyboard device of an electronic musical instrument, comprising:

a chassis;

a key disposed rotatably on the chassis with a side of a rotation center of the key as a rear and extending from the rear to a front;

a support shaft disposed on the chassis in front of the rotation center of the key;

a hammer disposed rotatably around the support shaft and rotating in conjunction with the key along with pressing on the front of the key;

a retaining hole founed through the hammer and retaining the support shaft such that the hammer is rotatable;

a guide groove formed by cutting open a rear of the retaining hole and guiding the support shaft in the retaining hole; and a shifting means, shifting from a temporarily secured state where the support shaft is temporarily secured in the guide groove of the retaining hole to a retained state where the support shaft is retained in the retaining hole, and pressing the hammer in the temporarily secured state toward the rear to shift the hammer to the retained state along with the pressing on the front of the key.

2. The keyboard device of the electronic musical instrument according to claim 1, wherein the shifting means comprises:

a protrusion protruding from the key toward the hammer;

a first contact part formed on a side surface of a rear of the protrusion to be in contact with the hammer in the temporarily secured state; and a first contacted part formed on the hammer to be in contact with the first contact part of the protrusion, wherein at least one of the first contact part of the protrusion and the first contacted part of the hammer is inclined downward from the rear to the front.

3. The keyboard device of the electronic musical instrument according to claim 2, wherein the first contact part of the protrusion and the first contacted part of the hammer are separated from each other when the hammer is in the retained state.

4. The keyboard device of the electronic musical instrument according to claim 2 , wherein the protrusion protruding from the key protrudes from a position in front of the support shaft; and a second contact part is formed on a tip part of the protrusion to be in contact with the hammer in the retained state and to be separated from the hammer in the temporarily secured state.

5. The keyboard device of the electronic musical instrument according to claim 2, wherein when the hammer is in the temporarily secured state and when the front of the key is pressed to shift the hammer to the retained state, the first contacted part is pressed obliquely downward and rearward by a force by the first contact part, by which the hammer is pressed rearward, and when a center of the support shaft is pressed to a position in front of a front end part of the guide groove, the support shaft is fitted into the retaining hole.

6. The keyboard device of the electronic musical instrument according to claim 2, wherein the guide groove has a tapered shape that is tapered from the rear of the retaining hole toward the retaining hole, and a minimum width of the guide groove is smaller than a diameter of the support shaft.

7. The keyboard device of the electronic musical instrument according to claim 2, wherein the hammer has an inclined surface that descends on a rear of the guide groove such that the support shaft is kept in the temporarily secured state.

8. The keyboard device of the electronic musical instrument according to claim 2, wherein a rear of the hammer behind the support shaft is heavier than a front of the hammer.

9. The keyboard device of the electronic musical instrument according to claim 2, wherein at least one of the first contact part of the protrusion and the first contacted part of the hammer is inclined downward to foam an inclination angle and the inclination angle is 22 degrees with respect to a vertical direction.

10. The keyboard device of the electronic musical instrument according to claim 2, wherein the support shaft protrudes from a sub-chassis of the chassis;

when the sub-chassis is injection-molded, a parting line is formed on the sub-chassis at a joint portion of a mold; and the parting line is formed in a front-rear direction at a same height as a center of the support shaft.

11. The keyboard device of the electronic musical instrument according to claim 10, wherein the guide groove is rotatable with respect to the parting line, such that the guide groove is inclined obliquely downward and rearward with respect to the parting line when the key is released, and extends in the front-rear direction in parallel to the parting line when the key is pressed.

12. The keyboard device of the electronic musical instrument according to claim 1, wherein the shifting means comprises:

a protrusion formed on the key and protruding from a position in front of the support shaft toward the hammer;

a contact part formed on a tip part of the protrusion to be in contact with the hammer in the temporarily secured state;

a guide member fixed to the chassis and located obliquely downward and forward with respect to the contact part of the protrusion;

a additional contact part formed on the guide member to be in contact with the hammer in the temporarily secured state; and a contacted part formed on the hammer to be in contact with the additional contact part of the guide member, wherein at least one of the additional contact part of the guide member and the contacted part of the hammer is inclined downward from the front to the rear.

13. The keyboard device of the electronic musical instrument according to claim 12, wherein the contact part of the protrusion is in contact with the hammer in the temporarily secured state and in contact with the hammer in the retained state; and the additional contact part of the guide member and the contacted part of the hammer are in contact with each other when the hammer is in the temporarily secured state and separated from each other when the hammer is in the retained state.

14. The keyboard device of the electronic musical instrument according to claim 12, wherein when the hammer is in the temporarily secured state and when the front of the key is pressed to shift the hammer to the retained state, the hammer is pressed rearward by a resultant force of a force that is pressed downward by the contact part and a force that the additional contact part presses the contacted part obliquely upward and rearward, and a center of the support shaft is pressed to a position in front of a front end part of the guide groove to fit the support shaft into the retaining hole.

15. The keyboard device of the electronic musical instrument according to claim 12, wherein the guide groove has a tapered shape that is tapered from the rear of the retaining hole toward the retaining hole, and a minimum width of the guide groove is smaller than the diameter of the support shaft.

16. The keyboard device of the electronic musical instrument according to claim 12, wherein the hammer has an inclined surface that descends on a rear of the guide groove such that the support shaft is kept in the temporarily secured state.

17. The keyboard device of the electronic musical instrument according to claim 12, wherein a rear of the hammer behind the support shaft is heavier than a front of the hammer.

18. The keyboard device of the electronic musical instrument according to claim 12, wherein at least one of the additional contact part of the guide member and the contacted part of the hammer is inclined downward to form an inclination angle and the inclination angle is 27 degrees with respect to a vertical direction.

19. The keyboard device of the electronic musical instrument according to claim 12, wherein the support shaft protrudes from a sub-chassis of the chassis;

when the sub-chassis is injection-molded, a parting line is formed on the sub-chassis at a joint portion of a mold; and the parting line is formed in a front-rear direction at a same height as a center of the support shaft.

20. The keyboard device of the electronic musical instrument according to claim 19, wherein the guide groove is rotatable with respect to the parting line such that the guide groove is inclined obliquely downward and rearward with respect to the parting line when the key is released and extends in the front-rear direction in parallel to the parting line when the key is pressed.

* * * * *